US010262584B2

(12) United States Patent
Qi et al.

(10) Patent No.: US 10,262,584 B2
(45) Date of Patent: Apr. 16, 2019

(54) PIXEL CIRCUIT, METHOD FOR DRIVING THE SAME, ARRAY SUBSTRATE AND DISPLAY DEVICE

(71) Applicants: BOE TECHNOLOGY GROUP CO., LTD., Beijing (CN); CHENGDU BOE OPTOELECTRONICS TECHOLOGY CO., LTD., Chengdu, Sichuan Province (CN)

(72) Inventors: Xiaojing Qi, Beijing (CN); Haigang Qing, Beijing (CN)

(73) Assignees: BOE TECHNOLOGY GROUP CO., LTD., Beijing (CN); CHENGDU BOE OPTOELECTRONICS TECHNOLOGY CO., LTD., Chengdu, Sichuan (CN)

( * ) Notice: Subject to any disclaimer, the term of this patent is extended or adjusted under 35 U.S.C. 154(b) by 1127 days.

(21) Appl. No.: 14/365,511

(22) PCT Filed: Oct. 24, 2013

(86) PCT No.: PCT/CN2013/085896

§ 371 (c)(1),
(2) Date: Jan. 16, 2015

(87) PCT Pub. No.: WO2015/007027

PCT Pub. Date: Jan. 22, 2015

(65) Prior Publication Data

US 2015/0116191 A1 Apr. 30, 2015

(30) Foreign Application Priority Data

Jul. 18, 2013 (CN) ..... 2013 1 0303355

(51) Int. Cl.
*G09G 3/3233* (2016.01)

(52) U.S. Cl.
CPC ... *G09G 3/3233* (2013.01); *G09G 2310/0256* (2013.01); *G09G 2310/08* (2013.01); *G09G 2320/043* (2013.01)

(58) Field of Classification Search
CPC ..... G09G 3/3233; G09G 2310/0256; G09G 2310/08; G09G 2320/043
See application file for complete search history.

(56) References Cited

U.S. PATENT DOCUMENTS

2004/0233145 A1 11/2004 Chiang
2009/0315874 A1* 12/2009 Kim ..... G09G 3/3233 345/213
2010/0289416 A1 11/2010 Yeh et al.

FOREIGN PATENT DOCUMENTS

CN 1231046 10/1999
CN 1815536 8/2006
(Continued)

OTHER PUBLICATIONS

International Search Report and Written Opinion issued in corresponding International Application No. PCT/CN2013/085896 dated Apr. 30, 2014.

(Continued)

*Primary Examiner* — Charles V Hicks
(74) *Attorney, Agent, or Firm* — Brooks Kushman P.C.

(57) ABSTRACT

The pixel circuit comprises a driving sub-circuit, a controlling sub-circuit and a light-emitting sub-circuit. The light-emitting sub-circuit includes a first organic light-emitting element and a second organic light-emitting element. The first and second organic light-emitting elements are coupled to the driving sub-circuit respectively. The controlling sub-circuit is coupled to the driving sub-circuit so as to control the driving sub-circuit to drive the first and second organic light-emitting elements, so that at an identical display stage, one of the first and second organic light-emitting elements (Continued)

emits light in a forward bias state and the other does not emit light in a backward bias state, and at an adjacent display stage, the bias states are switched.

20 Claims, 13 Drawing Sheets

(56) References Cited

FOREIGN PATENT DOCUMENTS

| | | |
|---|---|---|
| CN | 1886015 | 12/2006 |
| CN | 101122721 | 2/2008 |
| CN | 101208735 | 6/2008 |
| CN | 201177956 | 1/2009 |
| CN | 101937647 | 1/2011 |
| CN | 203070738 | 7/2013 |
| CN | 203480806 | 3/2014 |
| KR | 20080082065 | 9/2008 |

OTHER PUBLICATIONS

Text of the Notification of the First Office Action, App. No. 201310303355.3, dated Dec. 22, 2014.

* cited by examiner

PIXEL CIRCUIT, METHOD FOR DRIVING THE SAME, ARRAY SUBSTRATE AND DISPLAY DEVICE

CROSS-REFERENCE TO RELATED APPLICATION

This application is the U.S. national phase of PCT Application No. PCT/CN2013/085896 filed on Oct. 24, 2013, which claims priority to Chinese Patent Application No. 201310303355.3 filed on Jul. 18, 2013, the disclosures of which are incorporated in their entirety by reference herein.

TECHNICAL FIELD

The present invention relates to the field of display technology, in particular to a pixel circuit, a method for driving the same, an array substrate and a display device.

BACKGROUND

An active matrix organic light-emitting diode (AMOLED) display has been widely used over time because it can meet the requirements of a high-resolution and large-size display device.

For an AMOLED, a thin film transistor (TFT) generates a driving current in a saturation state so as to drive an organic light-emitting element, such as an organic light-emitting diode (OLED), to emit light. The OLED has attracted much attention and thus has been widely used in the field of organic light-emitting technology due to such advantages as low power consumption, high brightness, low production cost, wide viewing angle and rapid response.

When the organic light-emitting element is driven to emit light, it is required to inject electrons and holes between a transparent electrode layer as an anode and a metal electrode layer as a cathode respectively. The electrons and holes are recombined at a light-emitting layer, so as to change the electrons from an excited state to a ground state and thereby to release the excess energy in a form of light. However, the holes and electrons are injected into the light-emitting layer from the anode and the cathode respectively, and there usually exist some excess holes or electrons that do not take part in the recombination, so the efficiency of recombination is low. In addition, when an existing pixel circuit drives the organic light-emitting element to emit light, a transmission direction of the holes or electrons remains unchanged, and the excess holes or electrons that do not take part in the recombination may be accumulated at a surface of a hole transmission layer/electron transmission layer, or may get over a potential barrier and flows into the electrodes. Along with a long-term use of the organic light-emitting element, a large number of un-recombined carriers will be accumulated at an internal interface of the light-emitting layer, so that a built-in electric field is formed inside the organic light-emitting element. As a result, a threshold voltage of the organic light-emitting element is increased continuously, the brightness is decreased continuously, the energy efficiency is reduced gradually and the aging of the organic light-emitting element is getting worse.

SUMMARY

An object of the present disclosure is to provide a pixel circuit, a method for driving the same, an array substrate and a display device, so as to improve the recombination efficiency of carriers when an organic light-emitting element is driven to emit light, and to prevent the aging of the organic light-emitting element.

In one aspect, an embodiment of the present invention provides a pixel circuit, comprising a driving sub-circuit, a controlling sub-circuit and a light-emitting sub-circuit. The light-emitting sub-circuit includes a first organic light-emitting element and a second organic light-emitting element. The first and second organic light-emitting elements are coupled to the driving sub-circuit, respectively. The controlling sub-circuit is coupled to the driving sub-circuit so as to control the driving sub-circuit to drive the first and second organic light-emitting elements, so that at an identical display stage, one of the first and second organic light-emitting elements emits light in a forward bias state and the other does not emit light in a backward bias state, and at an adjacent display stage the bias states are switched.

The pixel circuit of an embodiment of the present invention comprises two organic light-emitting elements, the controlling sub-circuit and the driving sub-circuit. Under the control of the controlling sub-circuit, the driving sub-circuit can drive, at the identical display stage, one of the two organic light-emitting elements to emit light in the forward bias state and drive the other not to emit light in the backward bias state, and at the next display stage, switch the bias states. The un-recombined carriers that are accumulated at a surface of a hole transmission layer/electron transmission layer can change their movement directions at the adjacent display stages. As a result, it is able to remove a built-in electric field formed inside the organic light-emitting elements, improve the recombination efficiency of the carriers, prevent the aging of the organic light-emitting elements, and prolong the service life of the organic light-emitting elements.

Alternatively, the driving sub-circuit includes a first driving sub-circuit and a second driving sub-circuit. The first driving sub-circuit is coupled to an anode of the first organic light-emitting element and a cathode of the second organic light-emitting element, so as to drive the first organic light-emitting element to emit light in the forward bias stage and drive the second organic light-emitting element not to emit light in the backward bias state. The second driving sub-circuit is coupled to a cathode of the first organic light-emitting element and an anode of the second organic light-emitting element, so as to drive the second organic light-emitting element to emit light in the forward bias state and drive the first organic light-emitting element not to emit light in the backward bias state. The first and second driving sub-circuits are both coupled to the controlling sub-circuit.

In an embodiment of the present invention, the driving circuit includes the first and second driving sub-circuits so as to control the bias states of the organic light-emitting elements, respectively.

Alternatively, the first driving sub-circuit includes a first driving transistor, a first capacitor and a first reference voltage source. The second driving sub-circuit includes a second driving transistor, a second capacitor and a second reference voltage source. A drain electrode of the first driving transistor is coupled to the first reference voltage source, a gate electrode thereof is coupled to one end of the first capacitor, and a source electrode thereof is coupled to the other end of the first capacitor, the anode of the first organic light-emitting element and the cathode of the second organic light-emitting element. A drain electrode of the second driving transistor is coupled to the second reference voltage source, a gate electrode thereof is coupled to one end of the second capacitor, and a source electrode thereof is coupled to the other end of the second capacitor, the anode of the second organic light-emitting element and the cathode of the first organic light-emitting element. The controlling sub-circuit is coupled to the gate electrode of the first driving transistor and the gate electrode of the second driving transistor, respectively.

In an embodiment of the present invention, the first driving sub-circuit includes the first driving transistor, the first capacitor and the first reference voltage source, and the second driving sub-circuit includes the second driving transistor, the second capacitor and the second reference voltage source, and as a result, it is able to drive the organic light-emitting elements with a simple circuit.

Alternatively, the controlling sub-circuit includes a first switch transistor, a second switch transistor, a data signal source, a first gate signal source and a second gate signal source. A drain electrode of the first switch transistor is coupled to the data signal source, a gate electrode thereof is coupled to the first gate signal source, and a source electrode thereof is coupled to the gate electrode of the first driving transistor. A drain electrode of the second switch transistor is coupled to the data signal source, a gate electrode thereof is coupled to the second gate signal source, and a source electrode thereof is coupled to the gate electrode of the second driving transistor.

In an embodiment of the present invention, the controlling sub-circuit includes the first switch transistor, the second switch transistor, the data signal source, the first gate signal source and the second gate signal source, and as a result, it is able to control the bias states of the two organic light-emitting elements with a simpale circuit.

In another aspect, an embodiment of the present invention provides an array substrate comprising pixel units arranged in a matrix form and each defined by grid lines and data lines. Each pixel unit comprises a pixel circuit, and the pixel circuit is just the above-mentioned pixel circuit.

In yet another aspect, an embodiment of the present invention provides a display device comprising the above-mentioned array substrate.

According to the array substrate and the display device of embodiments of the present invention, the pixel circuit comprises two organic light-emitting elements, the controlling sub-circuit and the driving sub-circuit. Under the control of the controlling sub-circuit, the driving sub-circuit can drive, at the identical display stage, one of the two organic light-emitting elements to emit light in the forward bias state and drive the other not to emit light in the backward bias state, and at the next display stage, switch the bias states. The un-recombined carriers that are accumulated at a surface of a hole transmission layer/electron transmission layer can change their movement directions at the adjacent display stages. As a result, it is able to remove a built-in electric field formed inside the organic light-emitting elements, improve the recombination efficiency of the carriers, prevent the aging of the organic light-emitting elements, and prolong the service life of the organic light-emitting elements.

In yet another aspect, an embodiment of the present invention provides a method for driving a pixel circuit, comprising:

at a first display stage, controlling, by a controlling sub-circuit, a driving sub-circuit to drive a first organic light-emitting element and a second organic light-emitting element so that one of the first and second organic light-emitting elements emit light in a forward bias state and the other does not emit light in a backward bias state; and at a second display stage adjacent to the first display stage, controlling, by the controlling sub-circuit, the driving sub-circuit to switch the bias states of the first and second organic light-emitting elements.

According to the method for driving the pixel circuit of an embodiment of the present invention, at an identical display stage, one of the two organic light-emitting elements is driven to emit light in the forward bias state and the other is driven not to emit light in the backward bias state, and at the next display stage, the bias states are switched. The un-recombined carriers that are accumulated at a surface of a hole transmission layer/electron transmission layer can change their movement directions at the adjacent display stage. As a result, it is able to remove a built-in electric field formed inside the organic light-emitting elements, improve the recombination efficiency of the carriers, prevent the aging of the organic light-emitting elements, and prolong the service life of the organic light-emitting elements.

DETAILED DESCRIPTION OF THE PREFERRED EMBODIMENTS

The technical solutions of the present invention will be clearly and completely described hereinafter in conjunction with the drawings and the embodiments. Obviously, the following embodiments are merely a part of rather than all of, the embodiments of the present invention, and any other embodiments obtained by a person skilled in the art without any creative efforts shall also fall within the scope of the present invention.

First Embodiment

Figure 1:
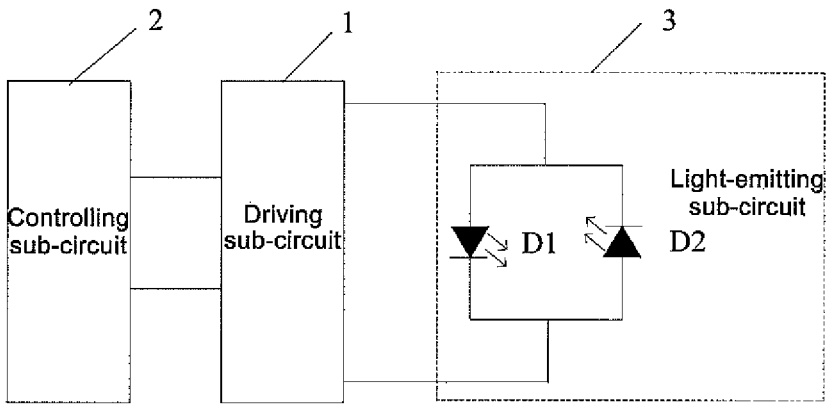
FIG. 1 is a schematic view showing a pixel circuit according to an embodiment of the present invention.

Referring to FIG. 1, a pixel circuit comprises a driving sub-circuit 1, a controlling sub-circuit 2 and a light-emitting sub-circuit 3.

The light-emitting sub-circuit 3 includes a first organic light-emitting element and a second organic light-emitting element, preferably OLEDs. The OLEDs, i.e., D1 and D2 in the drawings, are used as an example hereinafter, but the present invention is not limited thereto. The first OLED D1 and the second OLED D2 are coupled to the driving sub-circuit 1, respectively. The controlling sub-circuit 2 is coupled to the driving sub-circuit 1 so as to control the driving sub-circuit 1 to, at an identical display stage, drive one of D1 and D2 to emit light in a forward bias state and drive the other not to emit light in a backward bias state, and at a next display stage, switch the bias states.

It is to be noted that, in FIG. 1, the first OLED D1 and the second OLED D2 are parallelly coupled with each other in an opposite direction, but the present invention is not limited thereto, as long as the driving sub-circuit can, at the identical display stage, drive one of D1 and D2 to emit light in the forward bias state and drive the other not to emit light in the backward bias state, and at the next display stage, switch the bias states.

According to the pixel circuit of an embodiment of the present invention, the light-emitting sub-circuit includes two organic light-emitting elements and the controlling sub-circuit controls an on state of the driving sub-circuit. The driving sub-circuit, at the identical display stage, drives one of the two organic light-emitting elements to emit light in the forward bias state and drives the other not to emit light in the backward bias state, and at the next display stage, switches the, bias states. The un-recombined carriers that are accumulated at a surface of a hole transmission layer/electron transmission layer can change their movement directions at the adjacent display stage. As a result, it is able to remove a built-in electric field formed inside the organic light-emitting elements, improve the recombination efficiency of the carriers, prevent the aging of the organic light-emitting elements, and prolong the service life of the organic light-emitting elements.

Alternatively, when the controlling sub-circuit controls the driving sub-circuit to drive the same organic light-emitting element so that a duration of the forward bias state is equal to that of the backward bias state, it is able to further improve the recombination efficiency of the carriers, prevent the aging of the organic light-emitting elements, and prolong the service life thereof.

Second Embodiment

In this embodiment, the structure of the pixel circuit of the first embodiment will be described hereinafter in conjunction with the practical applications.

Also, in the light-emitting sub-circuit of the pixel circuit, the first OLED D1 and the second OLED D2 are taken as an example. The driving sub-circuit 1 includes a first driving sub-circuit 11 and a second driving sub-circuit 12. The first driving sub-circuit 11 is coupled to an anode of the first OLED D1 and a cathode of the second OLED D2, so as to drive the first OLED D1 to emit light in the forward bias state and drive the second OLED D2 not to emit light in the backward bias state. The second driving sub-circuit 12 is coupled to a cathode of the first OLED D1 and an anode of the second OLED D2, so as to drive the first OLED D1 not to emit light in the backward bias state and drive the second OLED D2 to emit light in the forward bias state.

Figure 2A:
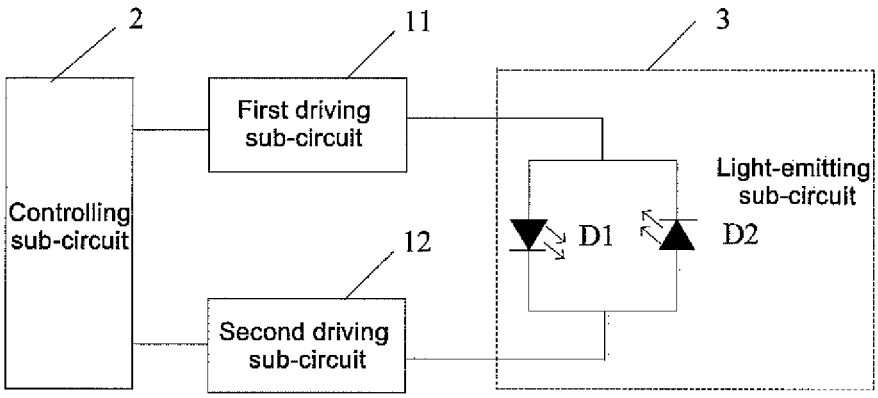
FIG. 2A is a schematic view showing the pixel circuit according to another embodiment of the present invention.

The first driving sub-circuit 11 and the second driving sub-circuit 12 are both coupled to the controlling sub-circuit 2, as shown in FIG. 2A.

Figure 2B:
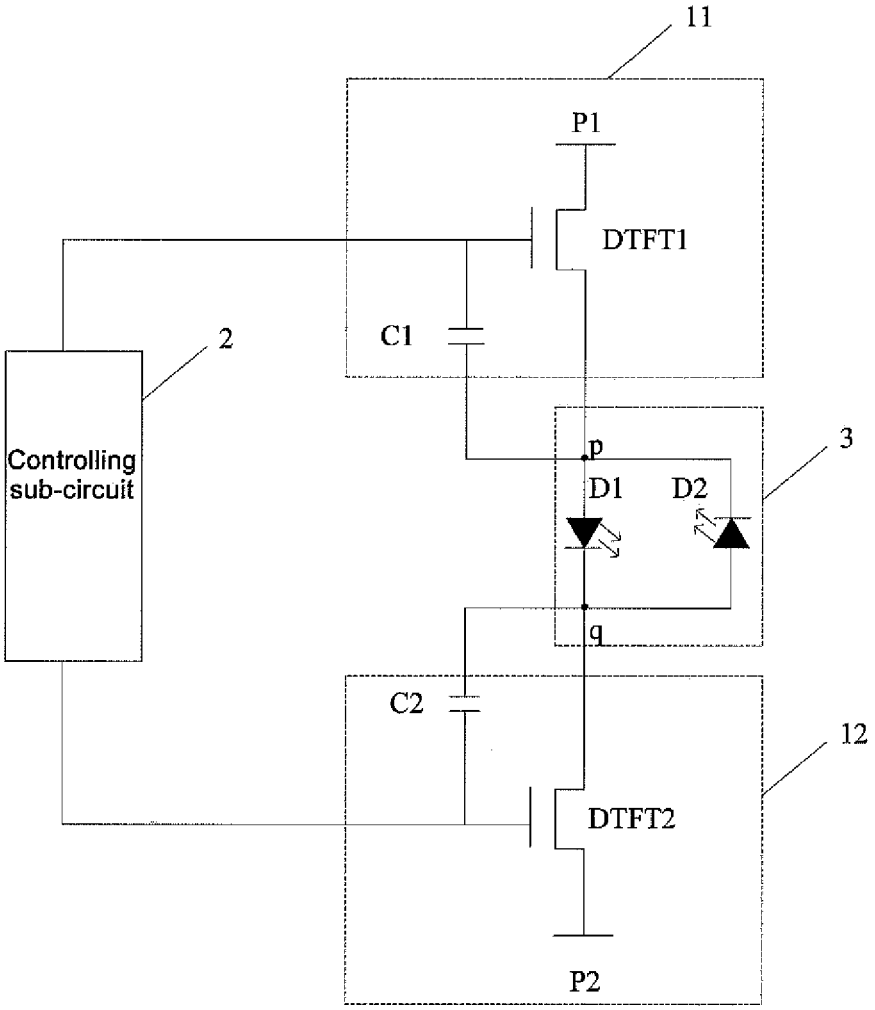
FIG. 2B is a schematic view showing the pixel circuit according to yet another embodiment of the present invention.

Further, the first driving sub-circuit 11 includes a first driving transistor DTFT1, a first capacitor C1 and a first reference voltage source P1, while the second driving sub-circuit 12 includes a second driving transistor DTFT2, a second capacitor C2 and a second reference voltage source P2, as shown in FIG. 2B.

It is to be noted that, the switch transistors and driving transistors used in the following embodiments of the present invention may be TFTs, FETs or other elements with the same characteristics. Since the source and drain electrodes of the transistors in the embodiments are symmetrical, they may be interchangable. In these embodiments, in order to distinguish the electrodes other than the gate electrode, one of them is called as a source electrode and the other is called as a drain electrode. For example, in accordance with the pattern in the drawings, an intermediate end of the transistor may be the gate electrode, a signal input end may be the drain electrode, and a signal output end may be a source electrode.

To be specific, a drain electrode of the first driving transistor DTFT1 is coupled to the first reference voltage source P1, a gate electrode thereof is coupled to one end of the first capacitor C1, and a source electrode thereof is coupled to the other end of the first capacitor C1, the anode of the first OLED D1 and the cathode of the second OLED D2.

A drain electrode of the second driving transistor DTFT2 is coupled to the second reference voltage source P2, a gate electrode thereof is coupled to one end of the second capacitor C2, and a source electrode thereof is coupled to the other end of the second capacitor C2, the anode of the second OLED D2 and the cathode of the first OLED D1.

As shown in FIG. 2B, the anode of the first OLED D1 and the cathode of the second OLED D2 are coupled to the source electrode of the first driving transistor DTFT1, the anode of the second OLED D2 and the cathode of the first OLED D1 are coupled to the source electrode of the second driving transistor DTFT2, so as to parallelly connect the first OLED D1 and the second OLED D2 in an opposite direction. At an identical display stage, the first driving transistor DTFT1 and the second driving transistor DTFT2 are both in an on state. One of them serves as a driving transistor, i.e., it provides a driving current so as to drive one of the first OLED D1 and the second OLED D2 to emit light in the forward bias state and drive the other not to emit light in the backward bias state. The other driving transistor serves as a switch transistor, i.e., it does not provide the driving current but is used to turn on the circuit. For example, when the first OLED D1 emits light in the forward bias state and the second OLED D2 does not emit light in the backward bias state, the first driving transistor DTFT1 serves as a driving transistor while the second driving transistor DTFT2 serves as a switch transistor.

The controlling sub-circuit 2 is coupled to the gate electrode of the first driving transistor DTFT1 and the gate electrode of the second driving transistor DTFT2, respectively, so as to control the first capacitor C1 and the second capacitor C2 to be charged, thereby to control the first driving transistor to drive the first OLED D1 to emit light in the forward bias state and drive the second OLED D2 not to emit light in the backward bias state, or control the second driving transistor to drive the first OLED D1 not to emit light in the backward bias state and drive the second OLED D2 to emit light in the forward bias state.

To be specific, the controlling sub-circuit 2 controls the first capacitor C1 and the second capacitor C2 to be charged. At an identical display stage, one of the first driving transistor DTFT1 and the second driving transistor DTFT2 serves as the driving transistor so as to provide the driving current, thereby to drive one of the first OLED D1 and the second OLED D2 to emit light in the forward bias state and drive the other not to emit light in the backward bias state. The other of the first driving transistor DTFT1 and the second driving transistor DTFT2 serves as the switch transistor, i.e., it does not provide the driving current but is used to turn on the circuit. At the identical display stage, the first driving transistor DTFT1 serves as the driving transistor and the second driving transistor DTFT2 serves as the switch transistor so that the first OLED D1 emits light in the forward bias state while the second OLED D2 does not emit light in the backward bias state, or the first driving transistor DTFT1 serves as the switch transistor and the second driving transistor DTFT2 serves as the driving transistor so that the first OLED D1 does not emit light in the backward bias state while the second OLED D2 emits light in the forward bias state.

To be specific, when at the identical display stage the first driving transistor DTFT1 is controlled to serve as the driving transistor and the second driving transistor DTFT2 is controlled to serve as the switch transistor so that the first OLED D1 emits light in the forward bias state while the second OLED D2 does not emit light in the backward bias state, the second capacitor C2 is charged and DTFT2 serves as the switch transistor while removing a data voltage in DTFT2, so as to maintain the gate electrode of DTFT2 at a turn-on voltage, turn on DTFT2 and maintain it in an on state. The first capacitor C1 is charged and DTFT1 serves as the driving transistor, so as to maintain the gate electrode of DTFT1 at the data voltage capable of driving the first OLED D1 to emit light, turn on DTFT1, drive the first OLED D1 to emit light in the forward bias state, and drive the second OLED D2 not to emit light in the backward bias state. At the next display stage, DTFT1 serves as the switch transistor and DTFT2 serves as the driving transistor, so as to drive the second OLED D2 to emit light in the forward bias state and drive the first OLED D1 not to emit light in the backward bias state.

The procedure of controlling the first driving transistor DTFT1 to serve as the switch transistor and controlling the second driving transistor DTFT2 to serve as the driving transistor so that the first OLED D1 does not emit light in the backward bias state while the second OLED D2 emits light in the forward bias state is similar to the procedure of controlling the first driving transistor DTFT1 to serve as the driving transistor and controlling the second driving transistor DTFT2 to serve as the switch transistor so that the first OLED D1 emits light in the forward bias state while the second OLED D2 does not emit light in the backward bias state, and it will not be repeated herein.

Figure 3:
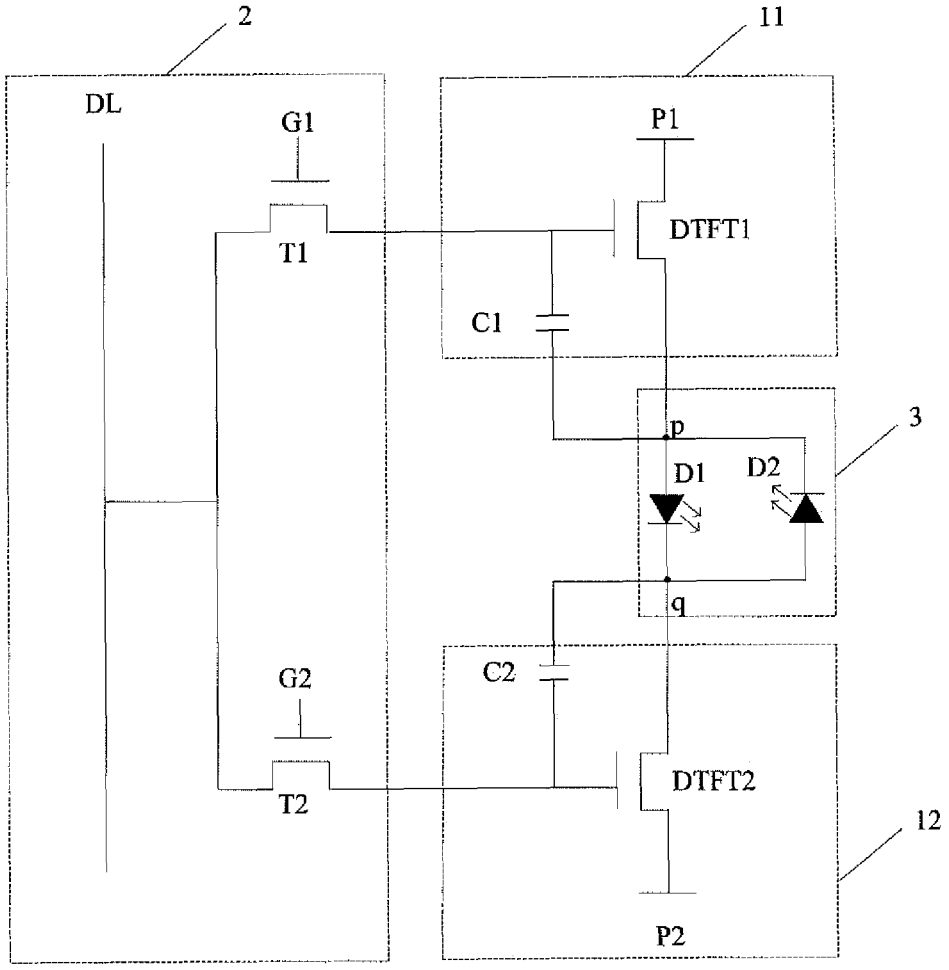
FIG. 3 is a schematic view showing the structure of the pixel circuit according to an embodiment of the present invention.

Alternatively, in this embodiment, the controlling sub-circuit 2 includes a first switch transistor T1, a second switch transistor T2, a data signal source DL, a first gate signal source G1 and a second gate signal source G2, as shown in FIG. 3.

To be specific, a drain electrode of the first switch transistor T1 is coupled to the data signal source DL, a gate electrode therof is coupled to the first gate signal source G1, and a source electrode thereof is coupled to the gate electrode of the first driving transistor DTFT1. The first gate signal source G1 is used to control the on or off state of the first switch transistor T1. When T1 is turned on, a branch where the data signal source DL and the gate electrode of the first driving transistor DTFT1 are located is turned on, and the first capacitor C1 is charged by the data signal source DL.

A drain electrode of the second switch transistor T2 is coupled to the data signal source DL, a gate electrode thereof is coupled to the second gate signal source G2, and a source thereof is coupled to the gate electrode of the second driving transistor DTFT2. The second gate signal source G2 is used to control the on or off state of the second switch transistor T2. When T2 is turned on, a branch where the data signal source and the gate electrode of the second driving transistor DTFT2 are located is turned on, and the second capacitor C2 is charged by the data signal source DL.

Alternatively, the first switch transistor T1, the second switch transistor T2, the first driving transistor DTFT1 and the second driving transistor DTFT2 may be N-type transistors which are turned on when the gate electrodes are at a high level and turned off when the gate electrodes are at a low level, or P-type transistors which are turned on when the gate electrodes at a low level and turned off when the gate electrodes at a high level. In order to simplify the manufacturing process, the first switch transistor T1, the second switch transistor T2, the first driving transistor DTFT1 and the second driving transistor DTFT2 are preferably all P-type transistors or N-type transistors.

Alternatively, the first switch transistor T1, the second switch transistor T2, the first driving transistor DTFT1 and the second driving transistor DTFT2 may be oxide transistors, so as to provide an even threshold voltage and improve the brightness uniformity of a display panel. Of course, they may also be transistors of any other types, e.g., TFTs manufactured by a low temperature polysilicon process or a-Si TFTs.

According to the pixel circuit of this embodiment, it can, at the identical display stage, drive one of the two organic light-emitting elements to emit light in the forward bias state and drive the other not to emit light in the backward bias state, and at the next display stage, switch the bias states. The movement directions of the un-recombined carriers that are accumulated at a surface of a hole transmission layer/electron transmission layer can be changed along with the change of the voltage. As a result, it is able to remove a built-in electric field formed inside the organic light-emitting elements, and prolong the service life thereof.

Third Embodiment

In this embodiment, a method for driving the pixel circuit according to the first or second embodiment is provided. In this method, at a first display stage, the controlling sub-circuit controls the driving sub-circuit to drive one of the first and second organic light-emitting elements to emit light in the forward bias state and drive the other not to emit light in the backward bias state, and at a second display state adjacent to the first display stage, the controlling sub-circuit controls the driving sub-circuit to switch the bias states of the first and second organic light-emitting elements.

Alternatively, in this embodiment, when the controlling sub-circuit controls the driving sub-circuit to drive the same organic light-emitting element so that the duration of the forward bias state is equal to that of the backward bias state, it is able to further improve the recombination efficiency of the carriers, prevent the aging of the organic light-emitting elements, and prolong the service life thereof.

It is to be noted that, in this embodiment, the first and second display stages may be any two display stages adjacent to each other, and they are not particularly defined. Alternatively, one display stage is defined in units of frame. Within a time period of one frame, one of the two organic light-emitting elements emits light in the forward bias state while the other does not emit light in the backward bias state. For the same organic light-emitting element, the duration of the forward bias state and the duration of the backward bias state are each a duration for one frame, i.e., the organic light-emitting element is switched from the forward bias state to the backward bias state, or vice verse, after the the time period of one frame.

When the driving sub-circuit includes the first driving sub-circuit having the first driving transistor, the first capacitor and the first reference voltage source, and the second driving sub-circuit having the second driving transistor, the second capacitor and the second reference voltage source, the step of controlling one of the first and second organic light-emitting elements to emit light in the forward bias state and controlling the other not to emit light in the backward bias may be achieved by:

charging, by the controlling sub-circuit, the first and second capacitors respectively, and when the first reference voltage source is at a high level and the second reference voltage source is at a low level, controlling the first driving transistor to drive the first organic light-emitting element to emit light in the forward bias state and drive the second organic light-emitting element not to emit light in the backward bias state, and when the first reference voltage source is at a low level and the second reference voltage source is at a high level, controlling the second driving transistor to drive the second organic light-emitting element to emit light in the forward bias state and drive the first organic light-emitting element not to emit light in the backward bias state.

Further, when the controlling sub-circuit includes the first switch transistor, the second switch transistor, the data signal source, the first gate signal source and the second gate signal source, the step of charging the first and second capacitors by the controlling sub-circuit may be achieved by:

controlling, by the first gate signal source, the first switch transistor to be turned on, so as to turn on a branch where the data signal source and the gate electrode of the first driving transistor are located and charge the first capacitor by the data signal source, and controlling, by the second gate signal source, the second switch transistor to be turned on, so as to turn on a branch where the data signal source and the gate electrode of the second driving transistor are located and charge the second capacitor by the data signal source.

Alternatively, when the first and second capacitors are charged, the first and second reference voltage sources are adjusted to be at a low or high level simultaneously, so that no current flows through the pixel circuit. As a result, it is able to eliminate the effect of internal resistance of the circuit on the light-emission current, and improve the quality of the image to be displayed.

In this embodiment, during the driving of the pixel circuit, at the identical display stage, one of the first and second organic light-emitting elements is controlled to emit light in the forward bias state and the other is controlled not to emit light in the backward bias state, and at the next adjacent display stage, the bias states are switched. In other words, at each display stage, only one organic light-emitting element emits light in the forward bias state and the other does not emit light in the backward bias state, and at the next display stage, the bias states of the two organic light-emitting elements are switched, i.e., the organic light-emitting element that emits light in the forward bias state at the previous display stage is switched not to emit light in the backward bias state, and the organic light-emitting element that does not emit light in the backward bias state at the previous display stage is switched to emit light in the forward bias state. As a result, it is able to consume the un-recombined carriers at an internal interface of a light-emitting layer of the organic light-emitting element. Further, for the same organic light-emitting element, the duration of the forward bias state may be equal to the duration of the backward bias state, and as a result, it is able to further improve the recombination efficiency of the carriers, improve the energy efficiency, and eliminate the effect of the built-in electric field.

Fourth Embodiment

Figure 4A:
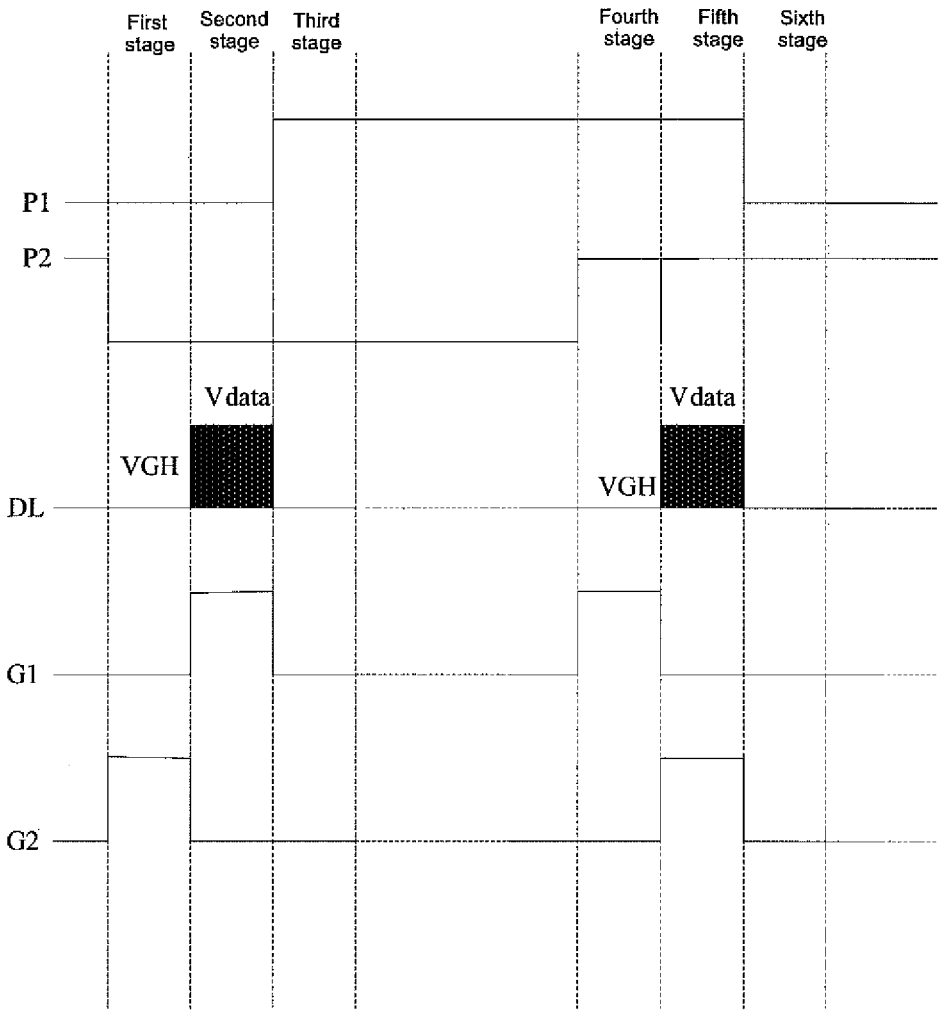
FIG. 4A is a time sequence diagram of the pixel circuit according to an embodiment of the present invention.

In this embodiment, the method for driving the pixel circuit and the procedure in which each module realizes its function will be described hereinafter in conjunction with the pixel circuit in FIG. 3 and the time sequence diagram of the pixel circuit in FIG. 4A.

The procedure of switching the bias states of the first OLED D1 and the second OLED D2 at the adjacent display stages so as to alternately emit light will be described hereinafter by taking the transistors in the pixel circuit in FIG. 3 being N-type TFTs as an example. The procedure includes six stages, where the first display stage includes a first stage, a second stage and a third stage, and the second display stage adjacent to the first display stage includes a fourth stage, a fifth stage and a sixth stage. For the P-type TFTs, a similar driving principle will be applied, merely with opposite level signals during operation, and it will not be repeated herein.

First Stage

Figure 5A:
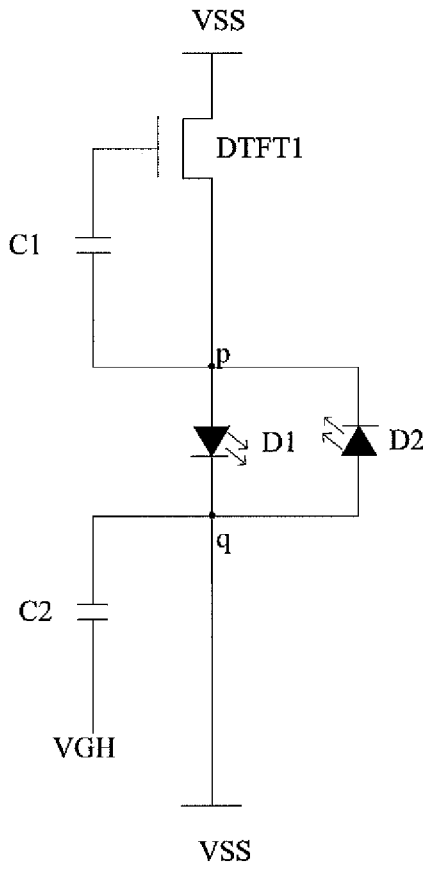
FIGS. 5A-5F are equivalent circuit diagrams of the pixel circuit at different stages according to an embodiment of the present invention.

The first gate signal source (a scanning control signal) G1 is at a low level and the second gate signal source (a scanning control signal) G2 is at a high level, so the first switch transistor T1 is turned off and the second switch transistor T2 is turned on. Meanwhile, the second reference voltage source P2 is transited from a high level VDD to a low level VSS, and the first reference voltage source P1 is at the low level VSS. The equivalent circuit is shown in FIG. 5A.

At the first stage, a signal from the data signal source DL is a voltage VGH capable of turning on the transistor, and VGH is not less than a threshold voltage of the transistor. C2 is charged by the data signal source DL via T2. At a previous display stage, the second OLED D2 emits light, DTFT2 serves as the driving transistor and the data voltage of DTFT2 is stored in C2. Hence, at this stage, C2 is charged by the data signal source DL via T2 and DTFT2 serves as the switch transistor while eliminating the data voltage of DTFT2, so as to maintain the gate electrode of DTFT2 at VGH, turn on DTFT2 and maintain it in an on state. At the same time, DTFT1 serves as the switch transistor in the previous display stage and the turn-on voltage is stored in C1, so as to maintain DTFT1 in the on state all the time. DTFT1 and DTFT2 are both in the on state, but at this time P1 and P2 are at the low level VSS, so there is no current flowing through the pixel circuit at this stage, and the first OLED D1 and the second OLED D2 are both in an off state and do not emit light.

Second Stage

Figure 5B:
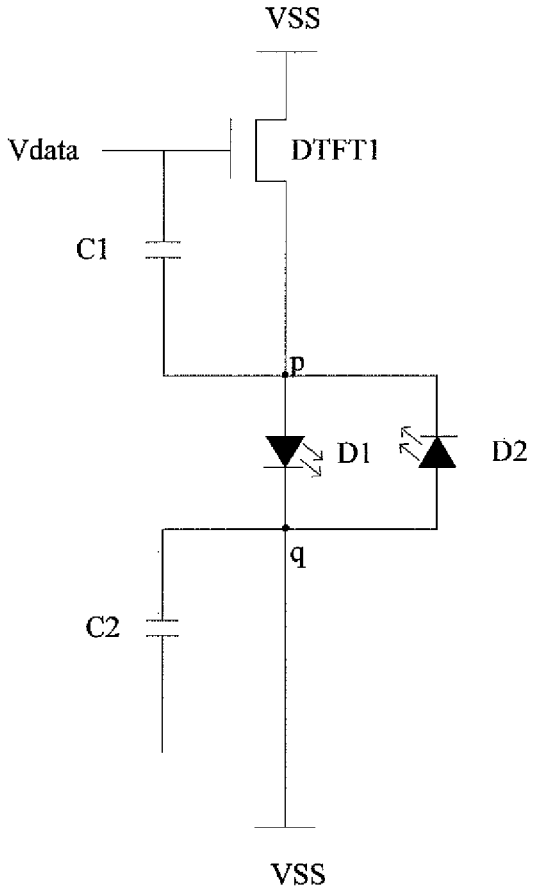

The first gate signal source G1 is at a high level and the second gate signal source G2 is at a low level, so the first switch transistor T1 is turned on and the second switch transistor T2 is turned off. The levels of P1 and P2 remain unchanged, i.e., at the low level VSS, and the data signal source DL is transited from the turn-on voltage VGH to the data voltage Vdata. The equivalent circuit is shown in FIG. 5B.

To be specific, at the second stage, T1 is turned on, T2 is turned off, and the voltage of the data signal source is Vdata. C1 is charged via T1 so that a potential for the gate electrode of DTFT1 is Vdata. Moreover, at the first stage, DTFT1 is in the on state and P1 is at the low level VSS, so point P in FIG. 3 is also at the low level VSS. Hence, a voltage across C1 is Vc1=Vdata-VSS.

Further, at the second stage, P1 and P2 are both at a low level, so there is still no current flowing through the pixel circuit, and the first OLED D1 and the second OLED D2 still do not emit light. In this embodiment, the first capacitor C1 and the second capacitor C2 are charged at the first stage and the second stage, respectively, and these two stages may be called as data write-in stages. At this stage, the reference voltage sources are both at a low level, so that no current flows through the pixel circuit. Hence, VSS is a power voltage set initially, i.e., the potential at point P is not affected by the internal resistance. For the pixel circuit arranged at any position of an array substrate, the voltage Vc1 across C1 is the same and will not be affected by the internal resistance either. As a result, the driving transistor outputs uniform current for driving the OLEDs to emit light, and thereby it is able to improve the quality of an image to be displayed.

Third Stage

The first gate signal source G1 and the second gate signal source G2 are both at a low level, and T1 and T2 are both turned off. P1 is transited from the low level VSS to the high level VDD, and P2 maintains at the low level VSS. DTFT1 serves as the driving transistor and outputs the driving current so that the first OLED D1 starts to emit light. DTFT2 serves as the switch transistor and does not output the driving current, so the second OLED D2 is in the backward bias stage and does not emit light. The equivalent circuit is shown in FIG. 5C.

At the third stage, DTFT1 serves as the driving transistor and outputs the driving current so that the first OELD D1 starts to emit light, i.e., the first OLED D1 is switched from the backward bias state to the forward bias state so as to emit light. DTFT2 serves as the switch transistor, and the second OLED D2 is in the backward bias state and does not emit light, i.e., the second OLED D2 is switched from the forward bias state to the backward bias state. The movement direction of the excess holes and electrons in the second OLED D2 that is in the backward bias state will be changed, i.e., they will move in a direction opposite to the movement direction when the second OLED D2 is in the forward bias state. As a result, these excess electrons and holes will be consumed relatively, and thereby the built-in electric field formed by the excess carriers inside the OLED when it is in the forward bias state will be attenuated. In addition, in this embodiment, for the same OLED, the duration of the forward bias state is controlled to be equal to the duration of the backward bias state through time sequence. As a result, it is able to improve the injection and recombination of the carriers, thereby to improve the recombination efficiency finally.

Figure 5C:
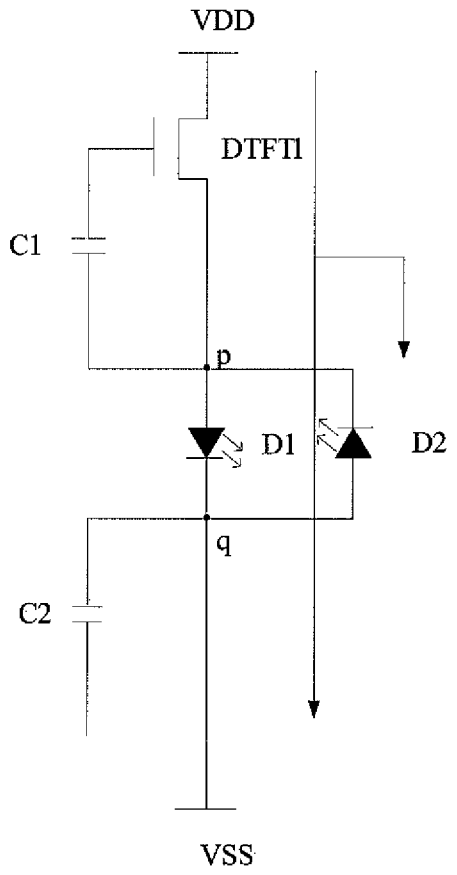

Further, as shown in FIG. 5C, the gate electrode of DTFT1 is in a open state, so a gate-to-source voltage of DTFT1 is just the voltage across C1, i.e., Vgs=Vc1=Vdata-VSS. The driving current flowing through DTFT1, i.e., a light-emission current of the OLED, is Ioled=kd(Vgs-Vthd)^2=kd(Vdata-VSS-Vthd)^2, wherein kd represents a constant associated with a process and driving design, and Vthd represents a threshold voltage of DTFT1. The driving current is affected by the data voltage and the threshold voltage of the driving transistor. The oxide transistor has an even threshold voltage, and for all the oxide transistors in the array substrate, the threshold voltage is almost of a fixed value. Hence, in this embodiment, oxide transistors are used as the switch transistors and the driving transistors, so as to prevent poor uniformity of the array substrate due to the uneven light emission. Of course, a LTPS TFT may also be used, and the transistor is not particularly defined in this embodiment.

After the completion of the above-mentioned stages, the driving of the pixel circuit at an initial period of the first display stage is completed. After a certain period of time (e.g., after the duration of one frame), the procedure enters the second display stage, and the driving procedure of the pixel circuit at an initial period of the second display stage may comprise the following stages.

Fourth Stage

Figure 5D:
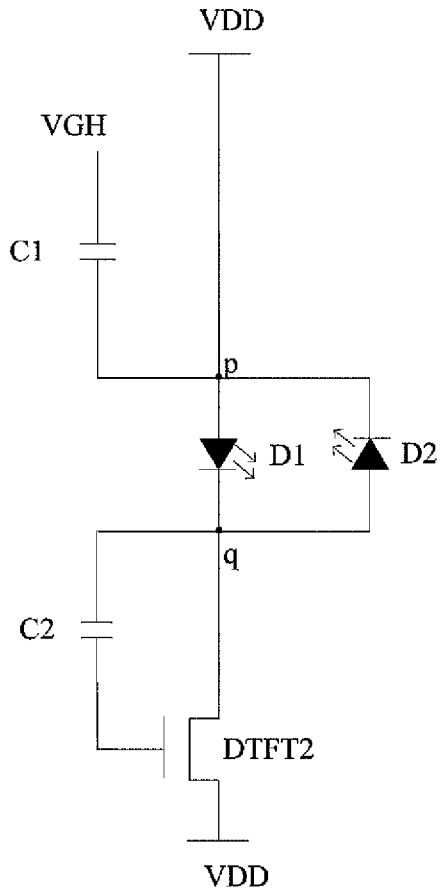

The first gate signal source G1 is at a high level and the second gate signal source G2 is at a low level, i.e., T1 is turned on and T2 is tuned off. Meanwhile, P2 is transited from the low level VSS to the high level VDD, and P1 still maintains at the high level VDD. The equivalent circuit is shown in FIG. 5D.

At the fourth stage, the signal from the data signal source DL is the turn-on voltage VGH of the transistor. At the previous stage, DTFT1 serves as the driving transistor and the data voltage capable of enabling the first OLED D1 to emit light is kept by C1. Hence, at this stage, C1 is charged by the data signal source DL via T1, and DTFT1 serves as the switch transistor while eliminating the data voltage of DTFT1, so that the gate electrode of DTFT1 is maintained at VGH, and DTFT1 is turned on. Meanwhile, at the previous display stage, DTFT2 serves as the switch transistor and the turn-on voltage is controlled by C2, so that DTFT2 is turned on all the time. P1 is at the high level VDD, so the potential at point 1 is increased to VDD. Both P1 and P2 are at the high level VDD and are completely the same, so at this stage, no current flows through the pixel circuit, and the first OLED D1 and the second OLED D2 are both in the off state and do not emit light.

Fifth Stage

Figure 5E:
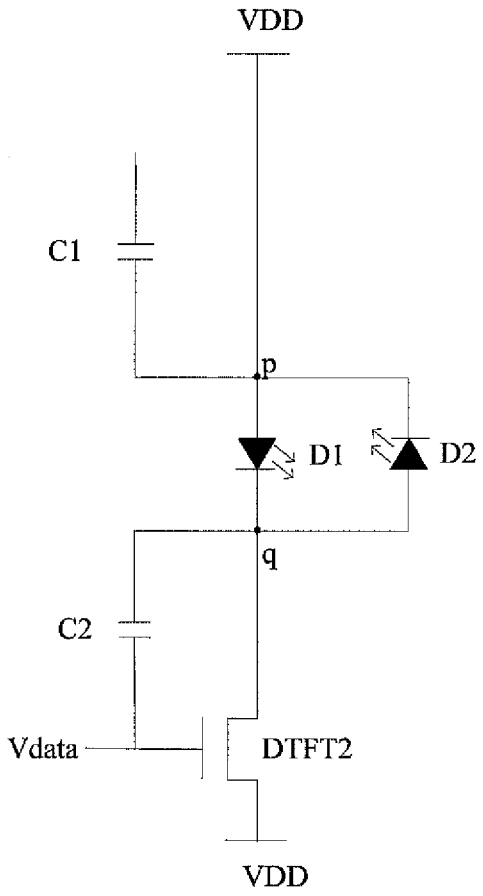

The first gate signal source G1 is at a low level and the second gate signal source G2 is at a high level, i.e., T2 is turned on and T1 is turned off. The equivalent circuit is shown in FIG. 5E.

At the fifth stage, the levels of P1 and P2 remain unchanged, i.e., they are still at the high level VDD, so the first OLED D1 and the second OLED D2 still do not emit light. The data signal source DL is transited from VGH to Vdata, and C2 is charged by Vdata via T2, so that the potential for the gate electrode of DTFT2 reaches Vdata. Meanwhile, the potential at point q is VDD, so the voltage across C2 is Vc2=Vdata-VDD.

Further, like at the first and second stages, there is still no current flowing through the pixel circuit at the fourth and fifth stages. Hence, VDD is the power voltage set initially, and for the pixel circuit arranged at any position, the voltage Vc2 across C2 is the same, i.e., it will not be affected by the internal resistance. As a result, the driving transistor will output uniform current for driving the OLEDs to emit light, and thereby it is able to improve the quality of an image to be displayed.

Sixth Stage

The first gate signal source G1 and the second gate signal source G2 are both at a low level so as to turn off T1 and T2. P1 is transited from the high level VDD to the low level VSS, and P2 maintains at the high level VDD. DTFT2 serves as the driving transistor and outputs the driving current so that the second OLED D2 is in the forward bias state and starts to emit light. DTFT1 serves as the switch transistor, and the first OLED D1 is in the backward bias state and does not emit light. The equivalent circuit is shown in FIG. 5F.

At the sixth stage, DTFT2 serves as the driving transistor and outputs the driving current so that the second OLED D2 starts to emit light, i.e., the second OLED D2 is switched from the backward bias state to the forward bias state. DTFT1 serves as the switch transistor, and the first OLED D1 is in the backward bias state and does not emit light, i.e., the first OLED D1 is switched from the forward bias state to the backward bias state. The movement direction of the excess holes and electrons in the first OLED D1 that is in the backward bias state will be changed, i.e., they will move in a direction opposite to the movement direction when the first OLED D1 is in the forward bias state. As a result, these excess electrons and holes will be consumed relatively, and thereby the built-in electric field formed by the excess carriers inside the OLED when it is in the forward bias state will be attenuated. As a result, it is able to improve the injection and recombination of the carriers when the OLED is switched to be in the forward bias state next time, thereby to improve the recombination efficiency finally.

Figure 5F:
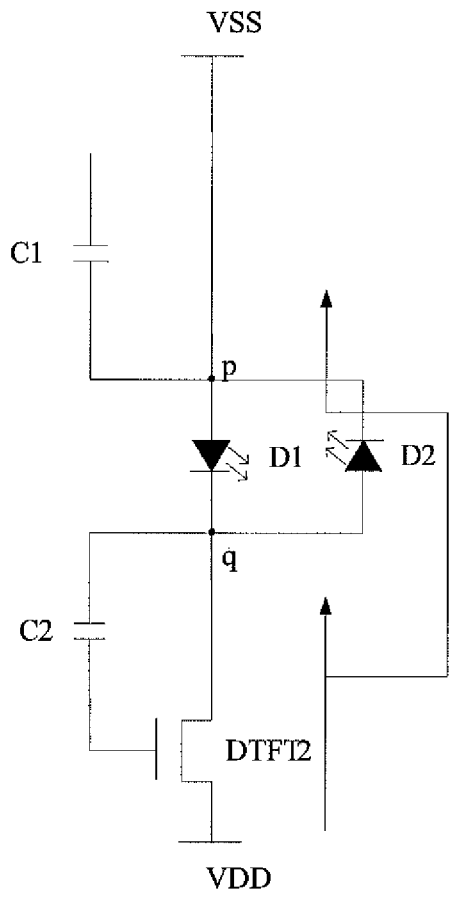

Further, as shown in FIG. 5F, at the sixth stage, the gate electrode of DTFT2 is in an open state, and the gate-to-source voltage of DTFT2 is just the voltage across C2, i.e., Vgs=Vc2=Vdata-VDD.

For the pixel circuit as shown in FIG. 3, all the transistors are N-type transistors, so the gate-to-source voltage shall be greater than 0, i.e., Vdata shall be greater than VDD.

Figure 6:
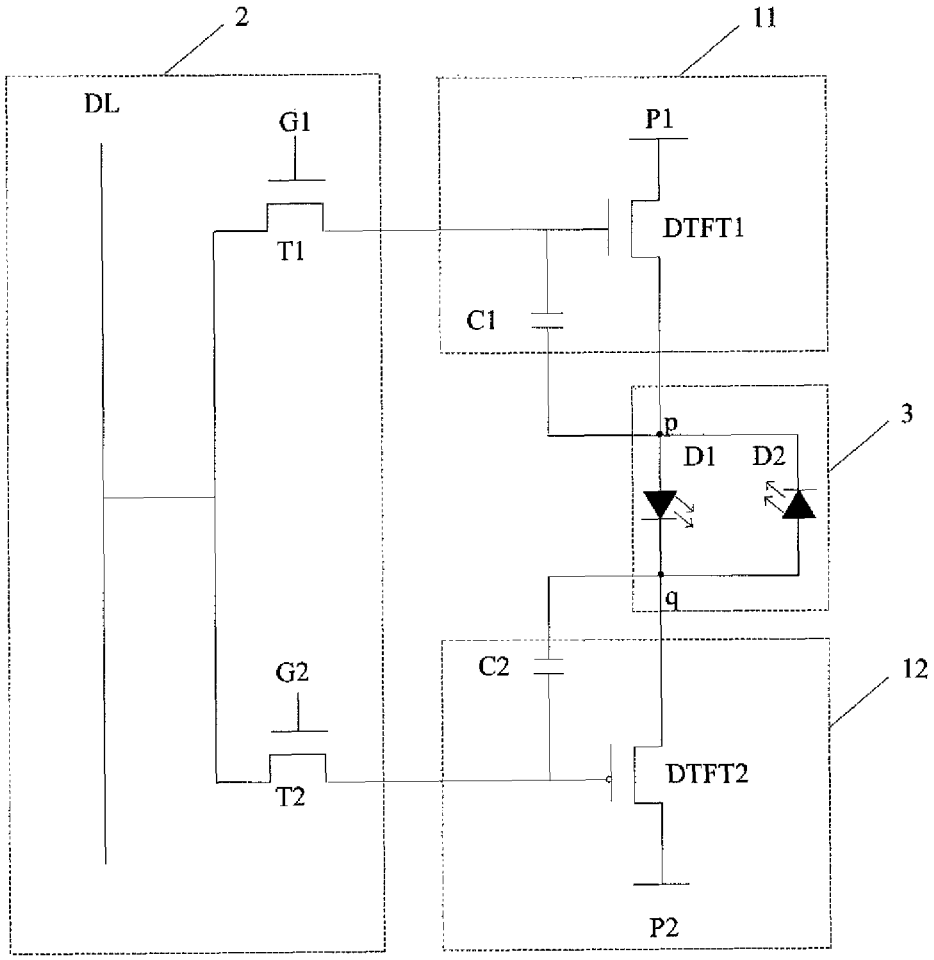
FIG. 6 is another schematic view showing the structure of the pixel circuit according to an embodiment of the present invention.

Further, in this embodiment, in order to prevent the data voltage from being designed to be greater than VDD, the first switch transistor T1 and the second switch transistor T2 may be the transistors of the same type, e.g., they may be both P-type transistors or N-type transistors. One of the first driving transistor DTFT1 and the second driving transistor DTFT2 may be a transistor of the same type as the first switch transistor T1 and the second switch transistor T2, and the other may be a transistor of a different type. For example, in the circuit as shown in FIG. 6, DTFT2 is a P-type transistor, while T1, T2 and DTFT1 are N-type transistors. When P1 and P2 are at the high level VDD simultaneously, the data voltage may be less than VDD, i.e., a high data voltage is not required.

Figure 4B:
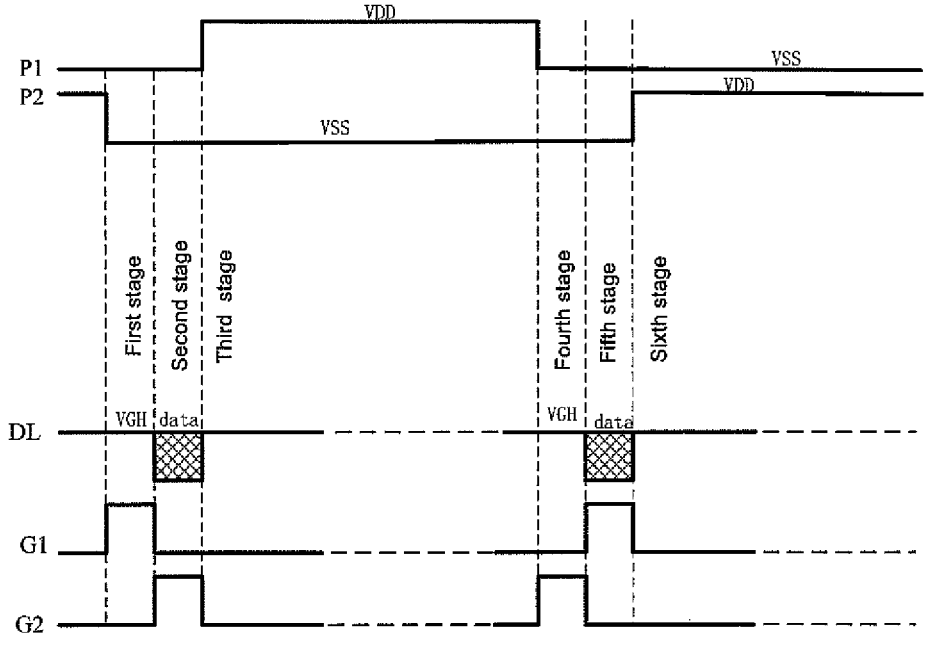
FIG. 4B is another time sequence diagram of the pixel circuit according to an embodiment of the present invention.

Further, in this embodiment, in order to prevent the data voltage from being greater than VDD, the time sequence operation as shown in FIG. 4B may also be performed. In this method, the procedures at the first, second and third stages are identical to those mentioned in FIG. 4A, merely with some differences at the fourth and fifth stages. During the time sequence operation as shown in FIG. 4B, at the fourth stage, P1 is transited from the high level VDD to the low level VSS and P2 maintains at the low level VSS. At the fifth stage, P1 and P2 still maintain at the low level VSS. At the sixth stage, P2 is transited from the low level VSS to the high level VDD, and P1 maintains at the low level VSS. Hence, at the sixth stage, the gate-to-source voltage of DTFT2 is just the voltage across C2, i.e., VC2=Vdata-VSS.

When the above method is used and T1, T2, DTFT1 and DTFT2 are all N-type transistors, Vdata may be of a relatively small value, but not necessarily be greater than VDD.

According to the pixel circuit and its driving method of the present invention, the pixel circuit comprises two OLEDs, the controlling sub-circuit and the driving sub-circuit. Under the control of the controlling sub-circuit, the driving sub-circuit can, at the identical display stage, drive one of the OLEDs to emit light in the forward bias stage and drive the other not to emit light in the backward bias stage, and at the next display stage, switch the bias stages. The movement direction of the un-recombined carriers that are accumulated at a surface of a hole transmission layer/electron transmission layer will be changed within adjacent frames, thereby the built in electric field formed inside the OLED will be eliminated. In addition, for the same OLED, the duration of the forward bias state is controlled to be equal to the duration of the backward bias state through the time sequence, and as a result, it is able to improve the recombination efficiency of the carriers.

Fifth Embodiment

Figure 7:
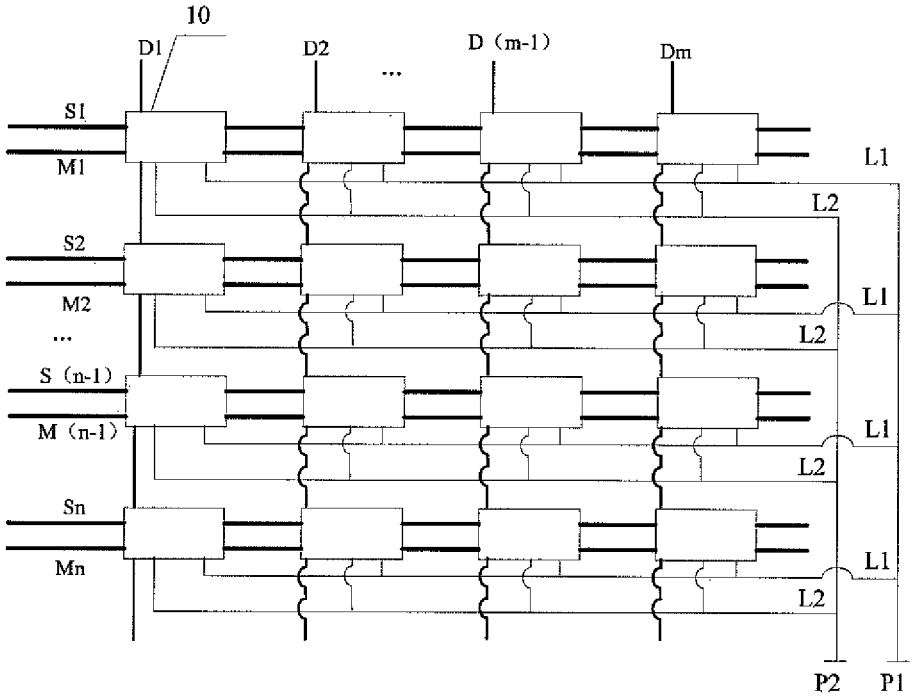
FIG. 7 is a schematic view showing an array substrate according to an embodiment of the present invention.

In this embodiment, an array substrate, as shown in FIG. 7, comprises:

a plurality of gate lines arranged in a row direction, e.g., S1, S2, . . . , Sn in FIG. 7;

a plurality of data lines arranged in a column direction, e.g., D1, D2, . . . , Dm in FIG. 7; and a plurality of pixel units arranged in a matrix form and each being defined by two adjacent gate lines and two adjacent data line.

Each pixel unit includes the pixel circuit 10 of the above embodiments. The pixel circuits 10 in an identical row are coupled to the same gate line, and those in an identical column are coupled to the same data line.

Alternatively, referring again to FIG. 7, the array substrate further comprises a first power signal line L1 through which the drain electrode of the first driving transistor is coupled to the first reference volate source P1, and a second power signal line L2 through which the drain electrode of the second driving transistor is coupled to the second reference power source P2.

Alternatively, the array substrate further comprises a plurality of controlling signal lines, e.g., M1, M2, . . . , Mn in FIG. 7. The drain electrode of the first switch transistor is coupled to the data signal source through the data line, and the gate electrode of the first switch transistor is coupled to the first gate signal source through the gate line. The drain electrode of the second switch transistor is coupled to the data signal source through the data line, and the gate electrode of the second switch transistor is coupled to the second gate signal source through the controlling signal line.

According to the array substrate of this embodiment, the pixel circuit comprises two organic light-emitting elements, the controlling sub-circuit and the driving sub-circuit. Under the control of the controlling sub-circuit, the driving sub-circuit can, at the identical display stage, drive one of the two organic light-emitting elements to emit light in the forward bias state and drive the other not to emit light in the backward bias state, and at the next display stage, switch the bias states, so that the two organic light-emitting elements emit light alternately. The movement direction of the un-recombined carriers that are accumulated at a surface of a hole transmission layer/electron transmission layer will be changed within adjacent display stages, thereby the built-in electric field formed inside the organic light-emitting element will be eliminated. In addition, for the same organic light-emitting element, the duration of the forward bias state is equal to the duration of the backward bias state, and the durations of the movement of the carriers after each time the movement direction is changed are equal. As a result, it is able to improve the recombination efficiency of the carriers.

Sixth Embodiment

In this embodiment, a display device comprising the array substrate of the fifth embodiment is provided. The other structures of the display device are the same as those in the prior art, and they will not be repeated herein.

It is to be appreciated that, the display device may be an OLED panel, an OLED display, an OLED TV, or an electronic paper.

According to the display device of this embodiment, the pixel circuit of the array substrate comprises two organic light-emitting elements, the controlling sub-circuit and the driving sub-circuit. Under the control of the controlling sub-circuit, the driving sub-circuit can, at the identical display stage, drive one of the two organic light-emitting elements to emit light in the forward bias state and drive the other not to emit light in the backward bias state, and at the next display stage, switch the bias states, so that the two organic light-emitting elements emit light alternately. The movement direction of the un-recombined carriers that are accumulated at a surface of a hole transmission layer/electron transmission layer will be changed within adjacent display stages, thereby the built-in electric field formed inside the organic light-emitting element will be eliminated. In addition, for the same organic light-emitting element, the duration of the forward bias state is equal to the duration of the backward bias state, and the durations of the movement of the carriers after each time the movement direction is changed are equal. As a result, it is able to improve the recombination efficiency of the carriers.

Obviously, a person skilled in the art may make modifications and variations to the present invention without departing from the spirit and scope of the present invention. If these modifications and variations fall within the scope of the appended claims and the equivalents thereof, the present invention also intends to include these modifications and variations.

What is claimed is:

1. A pixel circuit, comprising a driving sub-circuit, a controlling sub-circuit and a light-emitting sub-circuit, wherein the light-emitting sub-circuit comprises a first organic light-emitting element and a second organic light-emitting element;

the first organic light-emitting element and the second organic light-emitting element are coupled to the driving sub-circuit, respectively; and the controlling sub-circuit is coupled to the driving sub-circuit so as to control the driving sub-circuit to drive the first organic light-emitting element and the second organic light-emitting element, so that at an identical display stage, one of the first organic light-emitting element and the second organic light-emitting element emits light in a forward bias state and the other does not emit light in a backward bias state, and at an adjacent display stage the bias states are switched, wherein each of the first organic light-emitting element and the second organic light-emitting element comprises a cathode and an anode, the cathode of the first organic light-emitting element is directly connected to the anode of the second organic light-emitting element, and the anode of the first organic light-emitting element is directly connected to the cathode of the second organic light-emitting element.

2. The pixel circuit according to claim 1, wherein the driving sub-circuit comprises a first driving sub-circuit and a second driving sub-circuit, the first driving sub-circuit is coupled to an anode of the first organic light-emitting element and a cathode of the second organic light-emitting element, so as to drive the first organic light-emitting element to emit light in the forward bias state and drive the second organic light-emitting element not to emit light in the backward bias state, the second driving sub-circuit is coupled to a cathode of the first organic light-emitting element and an anode of the second organic light-emitting element, so as to drive the second organic light-emitting element to emit light in the forward bias state and drive the first organic light emitting element not to emit light in the backward bias state, and the first driving sub-circuit and the second driving sub-circuit are both coupled to the controlling sub-circuit.

3. The pixel circuit according to claim 2, wherein the first driving sub-circuit comprises a first driving transistor, a first capacitor and a first reference voltage source, the second driving sub-circuit comprises a second driving transistor, a second capacitor and a second reference voltage source, a drain electrode of the first driving transistor is coupled to the first reference votlage source, a gate electrode of the first driving transistor is coupled to one end of the first capacitor, and a source electrode of the first driving transistor is coupled to the other end of the first capacitor, the anode of the first organic light-emitting element and the cathode of the second organic light-emitting element, a drain electrode of the second driving transistor is coupled to the second reference voltage source, a gate electrode of the second driving transistor is coupled to one end of the second capacitor, and a source electrode of the second driving transistor is coupled to the other end of the second capacitor, the anode of the second organic light-emitting element and the cathode of the first organic light-emitting clement, and the controlling sub-circuit is coupled to the gate electrode of the first driving transistor and the gate electrode of the second driving transistor, respectively.

4. The pixel circuit according to claim 3, wherein the controlling sub-circuit comprises a first switch transistor, a second switch transistor, a data signal source, a first gate signal source and a second gate signal source, a drain electrode of the first switch transistor is coupled to the data signal source, a gate electrode of the first switch transistor is coupled to the first gate signal source, and a source electrode of the first switch transistor is coupled to the gate electrode of the first driving transistor, and a drain electrode of the second switch transistor is coupled to the data signal source, a gate electrode of the second switch transistor is coupled to the second gate signal source, and a source electrode of the second switch transistor is coupled to the gate electrode of the second driving transistor.

5. The pixel circuit according to claim 4, wherein the first switch transistor, the second switch transistor, the first driving transistor and the second driving transistor are all P-type or N-type transistors.

6. The pixel circuit according to claim 5, wherein the P-type or N-type transistors are oxide TFTs.

7. The pixel circuit according to claim 4, wherein the first switch transistor and the second switch transistor are both P-type or N-type transistors, and one of the first driving transistor and the second driving transistor is of an identical type to the first switch transistor and the second switch transistor.

8. An array substrate, comprising a plurality of pixel units arranged in a matrix form and defined by gate lines and data lines, each pixel unit comprising a pixel circuit, wherein the pixel circuit comprises a driving sub-circuit, a controlling sub-circuit and a light-emitting sub-circuit, wherein the light-emitting sub-circuit comprises a first organic light-emitting element and a second organic light-emitting element;

the first organic light-emitting element and the second organic light-emitting element are coupled to the driving sub-circuit, respectively; and the controlling sub-circuit is coupled to the driving sub-circuit so as to control the driving sub-circuit to drive the first organic light-emitting element and the second organic light-emitting element, so that at an identical display stage, one of the first organic light-emitting element and the second organic light-emitting element emits light in a forward bias state and the other does not emit light in a backward bias state, and at an adjacent display stage the bias states are switched, wherein each of the first organic light-emitting element and the second organic light-emitting element comprises a cathode and an anode, the cathode of the first organic light-emitting element is directly connected to the anode of the second organic light-emitting element, and the anode of the first organic light-emitting element is directly connected to the cathode of the second organic light-emitting element.

9. The array substrate according to claim 8, wherein the driving sub-circuit comprises a first driving sub-circuit and a second driving sub-circuit, the first driving sub-circuit is coupled to an anode of the first organic light-emitting element and a cathode of the second organic light-emitting element, so as to drive the first organic light-emitting element to emit light in the forward bias state and drive the second organic light-emitting element not to emit light in the backward bias state, the second driving sub-circuit is coupled to a cathode of the first organic light-emitting element and an anode of the second organic light-emitting element, so as to drive the second organic light-emitting element to emit light in the forward bias state and drive the first organic light-emitting element not to emit light in the backward bias state, and the first driving sub-circuit and the second driving sub-circuit are both coupled to the controlling sub-circuit.

10. The array substrate according to claim 9, wherein the first driving sub-circuit comprises a first driving transistor, a first capacitor and a first reference voltage source, the second driving sub-circuit comprises a second driving transistor, a second capacitor and a second reference voltage source, a drain electrode of the first driving transistor is coupled to the first reference voltage source, a gate electrode of the first driving transistor is coupled to one end of the first capacitor, and a source electrode of the first driving transistor is coupled to the other end of the first capacitor, the anode of the first organic light-emitting element and the cathode of the second organic light-emitting element, a drain electrode of the second driving transistor is coupled to the second reference voltage source, a gate electrode of the second driving transistor is coupled to one end of the second capacitor, and a source electrode of the second driving transistor is coupled to the other end of the second capacitor, the anode of the second organic light-emitting element and the cathode of the first organic light-emitting element, and the controlling sub-circuit is coupled to the gate electrode of the first driving transistor and the gate electrode of the second driving transistor, respectively.

11. The array substrate according to claim 10, wherein the controlling sub-circuit comprises a first switch transistor, a second switch transistor, a data signal source, a first gate signal source and a second gate signal source, a drain electrode of the first switch transistor is coupled to the data signal source, a gate electrode of the first switch transistor is coupled to the first gate signal source, and a source electrode of the first switch transistor is coupled to the gate electrode of the first driving transistor, and a drain electrode of the second switch transistor is coupled to the data signal source, a gate electrode of the second switch transistor is coupled to the second gate signal source, and a source electrode of the second switch transistor is coupled to the gate electrode of the second driving transistor.

12. The array substrate according to claim 11, wherein the first switch transistor, the second switch transistor, the first driving transistor and the second driving transistor are all P-type or N-type transistors.

13. The array substrate according to claim 12, wherein the P-type or N-type transistors are oxide TFTs.

14. The array substrate according to claim 13, wherein the first switch transistor and the second switch transistor are both P-type or N-type transistors, and one of the first driving transistor and the second driving transistor is of an identical type to the first switch transistor and the second switch transistor.

15. The array substrate according to claim 10, wherein the array substrate further comprises a first power signal line and a second power signal line, the drain electrode of the first driving transistor is coupled to the first reference voltage source via the first power signal line, and the drain electrode of the second driving transistor is coupled to the second reference voltage source via the second power signal line.

16. The array substrate according to claim 11, wherein the array substrate further comprises a controlling signal line, the drain electrode of the first switch transistor is coupled to the data signal source via the data line, and the gate electrode of the first switch transistor is coupled to the first gate signal source via the gate line, and the drain electrode of the second switch transistor is coupled to the data signal source via the data line, and the gate electrode of the second switch transistor is coupled to the second gate signal source via the controlling signal line.

17. A method for driving a pixel circuit, comprising the steps of:

at a first display stage, controlling, by a controlling sub-circuit, a driving sub-circuit to drive a first organic light-emitting element and second organic light-emitting element so that one of the first organic light-emitting element and the second organic light-emitting element emits light in a forward bias state and the other does not emit light in a backward bias state; and at a second display stage adjacent to the first display stage, controlling, by the controlling sub-circuit, the driving sub-circuit to switch the bias states of the first organic light-emitting element and the second organic light-emitting element, wherein each of the first organic light-emitting element and the second organic light-emitting element comprises a cathode and an anode, the cathode of the first organic light-emitting element is directly connected to the anode of the second organic light-emitting element, and the anode of the first organic light-emitting element is directly connected to the cathode of the second organic light-emitting element.

18. The method according to claim 17, wherein the step of controlling, by a controlling sub-circuit, a driving sub-circuit to drive a first organic light-emitting element and a second organic light-emitting element so that one of the first organic light-emitting element and the second organic light-emitting element emits light in a forward bias state and the other does not emit light in a backward bias state comprises:

when the driving sub-circuit comprises a first driving sub-circuit having a first driving transistor, a first capacitor and a first reference voltage source, and a second driving sub-circuit having a second driving transistor, a second capacitor and a second reference voltage source, charging, by the controlling sub-circuit, the first capacitor and the second capacitor, respectively;

when the first reference voltage source is at a high level and the second reference voltage source is at a low level, controlling the first driving transistor to drive the first organic light-emitting element to emit light in the forward bias state and drive the second organic light-emitting element not to emit light in the backward bias state; and when the first reference voltage source is at a low level and the second reference voltage source is at a high level, controlling the second driving transistor to drive the second organic light-emitting element to emit light in the forward bias state and drive the first organic light-emitting element not to emit light in the backward bias state.

19. The method according to claim 18, when the first capacitor and the second capacitor are charged by the controlling sub-circuit respectively, the method further comprises:

controlling the first reference voltage source and the second reference voltage source to be both at the low level or at the high level.

20. The method according to claim 17, wherein the controlling sub-circuit controls the driving sub-circuit to drive the same organic light-emitting element so that a duration of the forward bias state is equal to that of the backward bias state.

* * * * *